US007152894B2

(12) United States Patent
Weathers et al.

(10) Patent No.: US 7,152,894 B2
(45) Date of Patent: Dec. 26, 2006

(54) DEBRIS PACKER APPARATUS

(76) Inventors: Larry V. Weathers, 4850 Park Place East, North Charleston, SC (US) 29405; Linda Howell Weathers, 4850 Park Place East, North Charleston, SC (US) 29405

( * ) Notice: Subject to any disclaimer, the term of this patent is extended or adjusted under 35 U.S.C. 154(b) by 0 days.

(21) Appl. No.: 10/817,621

(22) Filed: Apr. 3, 2004

(65) Prior Publication Data

US 2005/0218674 A1 Oct. 6, 2005

(51) Int. Cl.
*A47F 13/06* (2006.01)

(52) U.S. Cl. ..... 294/1.1

(58) Field of Classification Search ..... 294/1.1, 294/3.5, 19.1, 51, 9, 2; 241/169.2; D7/682; 403/361

See application file for complete search history.

(56) References Cited

U.S. PATENT DOCUMENTS

| | | | | | |
|---|---|---|---|---|---|
| RE6,419 | E | | 5/1875 | Johnson | |
| 435,638 | A | | 9/1890 | Barnes | |
| 587,088 | A | | 7/1897 | Chamblin | |
| D43,064 | S | * | 9/1912 | Streeter | D7/682 |
| 1,167,782 | A | | 1/1916 | Richards | |
| 1,202,791 | A | | 10/1916 | Brownstein | |
| 1,856,954 | A | * | 5/1932 | Hayward | 241/169.2 |
| 2,347,963 | A | | 5/1944 | O'Neill | |
| 2,443,602 | A | | 6/1948 | Clark | |
| 2,575,978 | A | * | 11/1951 | Scheidecker | 241/169.1 |
| 2,738,818 | A | * | 3/1956 | Roi | 241/88.2 |
| D203,858 | S | | 2/1966 | Hvale | |
| 3,465,457 | A | | 9/1969 | Stone | |
| D219,305 | S | | 11/1970 | Mozneck | |
| 3,773,375 | A | | 11/1973 | Nehls | |
| 3,782,770 | A | | 1/1974 | Lee | |
| 3,799,099 | A | * | 3/1974 | Conover | 114/221 R |
| 3,848,841 | A | | 11/1974 | Rafeldt | |
| 3,952,812 | A | | 4/1976 | Lucan | |
| 4,312,531 | A | | 1/1982 | Cross | |
| D265,007 | S | | 6/1982 | Cuta | |
| 4,461,441 | A | | 7/1984 | Briggs | |
| 4,550,943 | A | | 11/1985 | Mirto | |
| 4,597,203 | A | | 7/1986 | Middleton | |
| 4,597,204 | A | | 7/1986 | Heiden | |
| D288,493 | S | | 2/1987 | Lopez | |
| D291,273 | S | | 8/1987 | Vosbikian | |
| 4,760,982 | A | | 8/1988 | Cooke | |
| 4,791,779 | A | | 12/1988 | Hoffman | |
| D304,872 | S | | 11/1989 | Jebb | |
| 4,892,223 | A | | 1/1990 | DeMent | |
| D308,270 | S | | 5/1990 | Sarabia | |
| D309,966 | S | | 8/1990 | Bishop | |

(Continued)

FOREIGN PATENT DOCUMENTS

| | | | |
|---|---|---|---|
| FR | 2607654 | * | 7/1986 |

*Primary Examiner*—Eileen D. Lillis
*Assistant Examiner*—Esther Onyinyechi Okezie
(74) *Attorney, Agent, or Firm*—Harleston Law Firm LLC; Kathleen M. Harleston

(57) ABSTRACT

A packer apparatus for pushing or packing leaves or other debris into a garbage container includes: (a) a substantially planar head portion; and (b) a cylindrically-shaped mount portion connected at one end to an underside of the head portion, and having an open opposite end that is insertable over an end of a handle of a rake or the like. The packer apparatus preferably further includes a spring loaded mechanism with two arm members, each comprising a spring, for removably attaching the packer apparatus to the handle.

5 Claims, 9 Drawing Sheets

U.S. PATENT DOCUMENTS 4,946,118 A 8/1990 Hastings
4,981,274 A 1/1991 McVay et al.
5,167,390 A 12/1992 Baghdadi
5,205,107 A 4/1993 Herink
5,207,107 A 5/1993 Wolf et al.
5,308,027 A 5/1994 Fullilove
D360,342 S 7/1995 Shea
5,546,738 A 8/1996 Turner
D376,237 S 12/1996 Hayes et al.
D391,815 S 3/1998 Venezio
5,785,369 A 7/1998 Ridley, Sr. et al.
5,799,996 A * 9/1998 Fredrickson ..... 294/51
D401,027 S 11/1998 Mueller
5,864,919 A 2/1999 Pineda
D425,763 S 5/2000 Begley et al.
6,109,362 A 8/2000 Simpson, Sr.
6,151,875 A 11/2000 Collins
6,155,522 A 12/2000 Anderson
D440,729 S 4/2001 Piner et al.
6,226,970 B1 5/2001 Busboom et al.
D447,392 S 9/2001 Johansson et al.
6,293,505 B1 9/2001 Fan
6,378,577 B1 4/2002 Piner et al.
6,450,461 B1 9/2002 Lohmann
6,450,557 B1 * 9/2002 Martinez ..... 294/19.1
6,536,488 B1 3/2003 Pochobradsky
6,708,742 B1 3/2004 Weathers et al.
D499,075 S 11/2004 Yoon et al.
D513,352 S 12/2005 Weathers et al.

* cited by examiner

DEBRIS PACKER APPARATUS

CROSS REFERENCE TO RELATED DOCUMENT

This invention was described in Disclosure Document Number 509296, which was received by the U.S. Patent & Trademark Office on Apr. 4, 2002.

BACKGROUND OF THE INVENTION

1. Technical Field

The present invention relates to a packer apparatus for pushing and packing fallen leaves or other debris into trash container.

2. Background Information

The governments of various municipalities all over the United States have passed laws prohibiting the dumping or burning of leaves and other debris in the municipality/county. The debris must therefore be collected in leaf and debris bags, sometimes a specific type, size, or color of bag, and set on the curb for pickup by a trash service, or hauled to a specified disposal location. Unfortunately, raking up and bagging fall leaves or summer yard clippings is difficult for an individual to undertake, particularly if the individual is handicapped or infirm. Once the fallen leaves are raked into piles, it is difficult to hold the leaf bag open and at the same time insert handfuls of slippery leaves. Some people put one foot on the edge of the leaf and debris bag, lean over and hold the bag open with one hand, and attempt to scoop in leaves with the other hand. Since only comparatively few leaves can be inserted with each handful or rake full, the job is labor intensive and sometimes results in back sprains, spasms, and aching muscles.

The inexpensive leaf packer apparatus of the present invention makes collecting leaves quicker and easier. The leaf packer apparatus is used to pack leaves down into a trash container or bag. It is most helpful when used in conjunction with the chute apparatus described in U.S. Pat. No. 6,708,742, Weathers et al., issued Mar. 23, 2004. Its preferred embodiments fit on one end of a conventional rake, so it is not necessary to use two separate tools for raking and packing down the leaves in the container. The leaf packer markedly decreases the amount of bending and stretching necessary to do yard work, and is especially helpful for older or infirm people. It can also be used for packing outdoor trash, such as discarded napkins, paper cups, brochures, and other debris, after a church festival, for example, into trash containers.

Using the packer apparatus allows more trash to be packed into a container, thereby decreasing the number of times the trash container must be emptied, and/or the number of new containers/bags needed to collect the trash. Where trash collection companies charge according to the number of full trash containers removed from a site, the packer apparatus should also decrease trash collection costs.

BRIEF SUMMARY OF THE INVENTION

The present invention is a packer apparatus for use in conjunction with a conventional trash container, and preferably also a leaf chute according to U.S. Pat. No. 6,708,742, Weathers et al. In its preferred embodiments, the packer apparatus is removably attachable to a handle of a standard yard rake for easy access during raking activity. To utilize the packer apparatus, a user first rakes fallen leaves or other yard debris, such as grass clippings, brush, debris from pruning, weeds, twigs, etc., with the rake's tines into the patented leaf chute, or directly into the conventional trash container. The user then turns the rake around to access the packer apparatus and uses the end of the packer apparatus to push and pack the fallen leaves or debris from the leaf chute into a conventional plastic or paper leaf bag, which is attached to the leaf chute, or into a conventional trash/garbage can or other rigid container. The user may attach the packer apparatus to any available broomstick-type handle, including a handle of another yard tool.

First and second embodiments of the packer apparatus comprises a planar head and a generally cylindrical, hollow mount having a closed end connected to a side of the head and an open end removably insertable on the handle of a yard rake, wherein the hollow mount is oriented substantially perpendicularly to the side of the head. A first embodiment of the packer apparatus comprises a spring loaded clamp for removably binding the mount to the handle. A second embodiment of the packer apparatus comprises at least one screw hole extending transversely through the mount for removably binding the mount to the handle with a screw.

A third embodiment of the packer apparatus is not removably attachable to the handle of a yard rake, but is itself a complete tool. The third embodiment includes:

(a) a planar head portion that is generally rectangular in shape;

(b) a first side wall extending generally perpendicularly up from the head portion along a first, shorter edge of the head portion;

(c) a second side wall extending generally perpendicularly up from the head portion along a first, longer edge of the head portion;

(d) a third side wall extending generally perpendicularly up from the head portion along a second, shorter edge of the head portion that is opposite and oriented generally parallel to the first, shorter edge of the head portion; and (e) an angled handle attached to a central portion of a generally planar side of the head portion.

A fourth embodiment of the packer apparatus includes a planar head, a conically shaped brace protruding from a side of the head with the brace's longitudinal axis being oriented substantially perpendicularly to the side of the head, and a generally cylindrical, hollow mount portion having a first, open end connected to a frustum of the brace and a second, open end removably insertable on the handle of a yard rake. A fifth embodiment of the packer apparatus further includes a spring-loaded mechanism, which locks and unlocks the mount portion from the handle. A sixth embodiment of the packer apparatus includes an angled head portion.

The packer apparatus benefits users as it reduces the time and energy required for yard debris collection, especially removal of fallen leaves. Likewise, it relieves stress and strain on the yard debris collector's body because he/she must not continuously or repeatedly bend or crouch to put handfuls of debris from a raked pile of debris into a leaf bag. In short, it makes yard debris collection with the leaf chute described in U.S. Pat. No. 6,708,742, Weathers et al. easier. Some yard rakes are shaped awkwardly and it is difficult to send all yard debris from the leaf chute into an attached leaf bag or another type of trash container with a rake. The packer apparatus provides the debris collector with an additional tool to encourage the yard debris from the leaf chute into an attached leaf bag.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
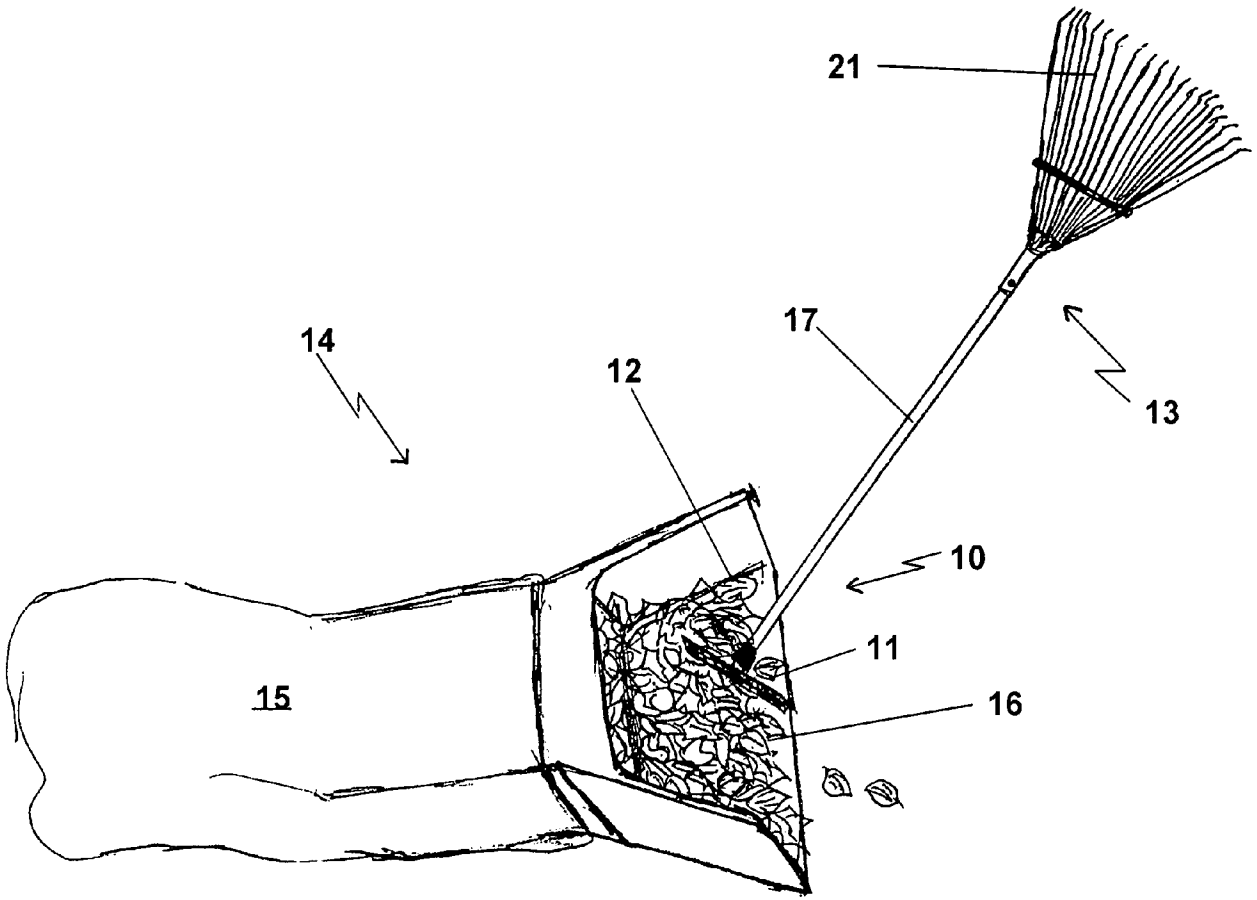
FIG. 1 is a perspective view of a first embodiment packer apparatus according to the present invention, shown in use on a handle of a standard yard rake.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a debris packer apparatus according to the present invention, which is generally referred to as 10, is shown in use on an end of a handle 17 of a conventional yard rake 13. As shown in FIG. 1, the packer apparatus 10 works in unison with a chute apparatus 14 disclosed in U.S. Pat. No. 6,708,742, Weathers et al., issued Mar. 23, 2004, which is attached to a conventional plastic or paper leaf and debris bag 15 and holds the bag 15 open. To use the packer apparatus, a user rakes a pile of fallen leaves 16 or other debris, such as cut grass, onto the chute apparatus 14 with the rake 13. Then, holding onto the handle 17 of the rake 13, the user pushes the fallen leaves 16 or other debris into the disposable yard bag 15 with the packer apparatus 10. Once the fallen leaves 16 are in the bag 15, the user may continue to push them further into the leaf bag 15, compacting them so that he or she can fit additional piles of fallen leaves 16 into the leaf bag 15. Having a dual purpose tool allows the user to rake with one end, and push and pack with the packer apparatus on the other end. A rake is often too wide to fit in many paper leaf bags and trash containers, and is not suited for pushing and compacting leaves or other debris.

Figure 2:
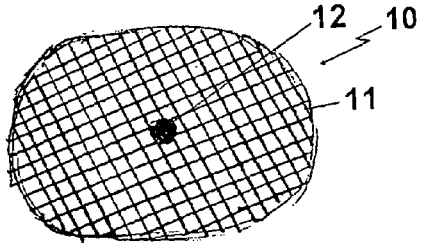
FIG. 2 is a top plan view of a first embodiment of a packer apparatus according to the present invention.
Figure 3:
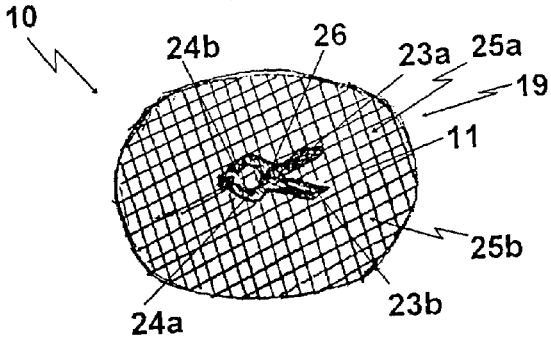
FIG. 3 is a bottom plan view of a first embodiment of a packer apparatus according to FIG. 2.

Referring next to FIGS. 2 through 5, a first embodiment of the packer apparatus 10 comprises a generally planar head portion 11, a substantially hollow mount portion 12, and a spring-loaded clamp 19. The head portion 11 may have any shape that is suitable for pushing and packing debris, but preferably is generally ovular (as shown in FIGS. 2 and 3), circular, or rectangular in shape. The head portion 11 may be solid (i.e., not comprise apertures) or grate-like (i.e., comprise a plurality of substantially same-sized apertures) as shown in FIGS. 2 and 3. The grating allows for a strong yet lightweight packer apparatus that is nevertheless suitable for packing larger sized debris such as fallen leaves, mown grass, and paper trash. The hollow mount portion 12 is generally cylindrical in shape, and has a closed end and an open end. The closed end of the mount portion 12 is attached to an underside of the head portion 11 by means of an adhesive, nuts and bolts, or any other suitable attachment mechanism with the mount portion 12 oriented substantially perpendicularly to the head portion 11 (see FIGS. 4 and 5).

Figure 4:
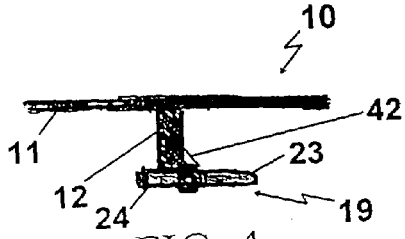
FIG. 4 is a side elevational view of the first embodiment of the packer apparatus according to FIG. 2.

Referring to the embodiment shown in FIGS. 3 and 4, the spring-loaded clamp 19 is permanently affixed to the mount portion 12 near the open end of the mount portion 12. The clamp 19 is for removably securing the packer apparatus 10 to the handle 17 of a standard yard rake 13. The spring-loaded clamp 19 is comprised of a first member 25*a*, and a second member 25*b* pivotally attached to the first member 25*a* by a pivot pin 26, such that the first member 25*a* and the second member 25*b* cross over one another at the pivot pin 26. Adjacent ends of members 25*a*, 25*b* comprise a first hand grip 23*a* and a second hand grip 23*b*, respectively, while opposite adjacent ends of members 25*a*, 25*b* comprise a first clamp arm 24*a* and a second clamp arm 24*b*, respectively. A clamp spring (not shown) extending between the first member 25*a* and the second member 25*b* facilitates movement of the spring-loaded clamp 19 between an open position and a closed position. The spring-loaded clamp 19 is attached to the mount portion 12 by a mount arm 42. The mount arm 42 is attached at one end to the mount portion 12 and at an opposite end to the cross-over portion of the spring-loaded clamp 19.

In the closed position, as illustrated in FIG. 3, a free end of the first clamp arm 24*a* contacts a corresponding free end of the second clamp arm 24*b* such that the clamp arms 24*a*, 24*b* encircle and tightly grip the mount portion 12. Squeezing the hand grips 23*a*, 23*b* towards one other moves the clamp arms 24*a*, 24*b* out of contact and away from each other into an open position and releases the grip of the clamp arms on the mount portion 12. The clamp spring stretches as the clamp arms 24*a*, 24*b* separate. Consequently, when the clamp spring is fully extended, the outward movement of the clamp arms 24*a*, 24*b* halts. Releasing the inwardly directed pressure on the hand grips 23*a*, 23*b* allows the clamp spring to relax, which in turn returns the clamp arms 24*a*, 24*b* to the closed position.

Figure 5:
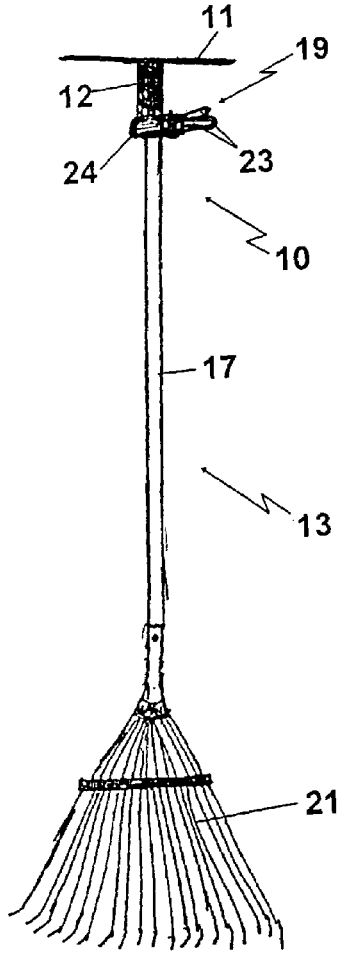
FIG. 5 is a side elevational view of the first embodiment of the packer apparatus according to FIG. 2, shown mounted on a handle of a standard yard rake with a clamp.
Figure 6:
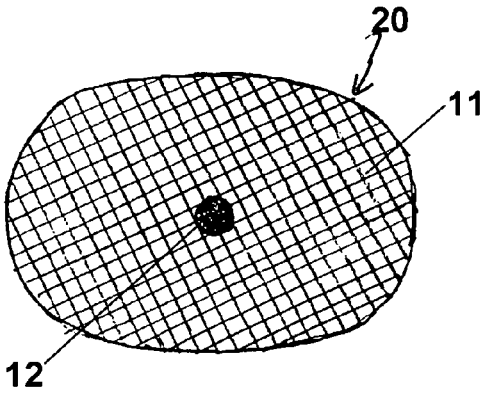
FIG. 6 is a top plan view of a second embodiment of a packer apparatus according to the present invention.
Figure 7:
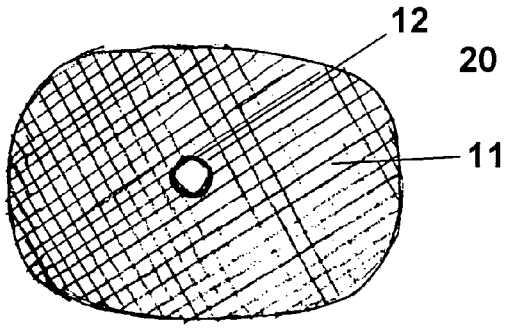
FIG. 7 is a bottom plan view of the second embodiment of the packer apparatus according to FIG. 6.
Figure 8:
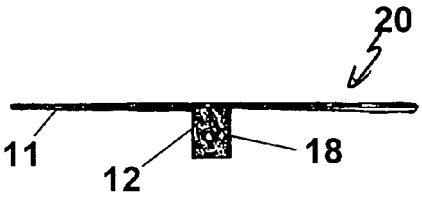
FIG. 8 is a side elevational view of the second embodiment of the packer apparatus according to FIG. 6.

With attention to FIG. 5, the mount portion 12 is removably securable on an end of a handle 17 of a standard yard rake 13 opposite the tines 21 of the rake. Installation of the packer apparatus 10 on the handle 17 of the rake 13 is accomplished in three easy steps. First, the user simply squeezes the hand grips 23*a*, 23*b* towards one another to move the clamp arms 24*a*, 24*b* into an open position and release the clamp arms from the mount portion 12. Secondly, the user inserts the open end of the mount portion 12 over the end of the rake handle 17. Thirdly, the user releases the hand grips 23*a*, 23*b* to move the clamp arms 24*a*, 24*b* into the closed position, which vises the mount portion 12 and the rake handle 17. The packer apparatus 10 remains firmly on the handle 17 during use.

To remove the packer apparatus 10 from the handle 17, the user again follows three easy steps. First, the user squeezes the hand grips 23*a*, 23*b* towards on another to move the clamp arms 24*a*, 24*b* into an open position. Secondly, the user pulls the mount portion 12 off the handle 17. Thirdly, the user releases the hand grips 23*a*, 23*b*, which moves the clamp arms 24*a*, 24*b* into the closed position.

Figure 9:
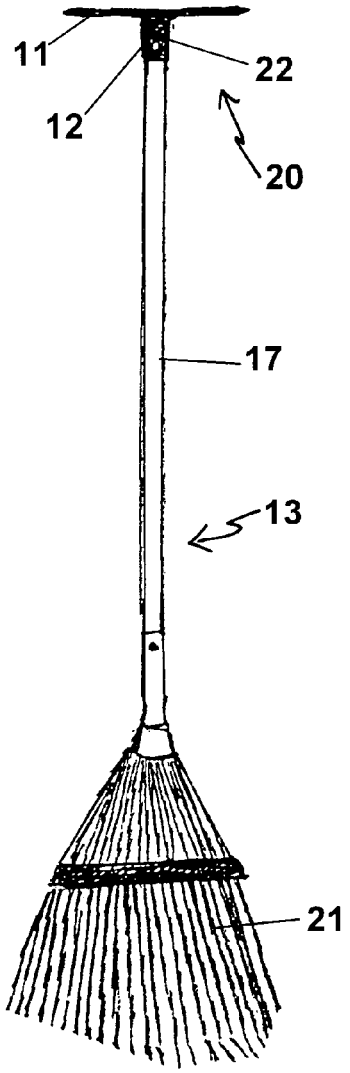
FIG. 9 is a side elevational view of the second embodiment of the packer apparatus according to FIG. 6, shown mounted on a handle of a standard yard rake.

A second embodiment 20 of the instant packer apparatus is shown in FIGS. 6 through 9. This embodiment is the same as the first embodiment, except that this embodiment comprises at least one screw hole 18, and at least one screw 22 instead of a spring-loaded clamp for removable installation of the packer apparatus 20 on the handle 17 of a rake 13. Looking at FIG. 8, the screw hole 18 extends substantially transversely through the mount portion 12. As shown in FIG. 9, in order to removably secure the packer apparatus 20 to the handle 17, the screw 22 extends through the screw hole 18 and through a corresponding, similarly sized and shaped, at least one pre-drilled hole (not shown) extending substantially transversely through the handle 17.

FIG. 9 shows the packer apparatus 20 installed on the handle 17 of a standard yard rake 13 opposite tines 21. To install the packer apparatus 20 on the handle 17, the user first inserts the mount portion 12 on the handle 17 through the open end of the mount portion 12, so that the screw hole 18 and the corresponding pre-drilled hole (not shown) align. Secondly, the user fastens the screw 22 through the screw hole 18 and the corresponding pre-drilled hole (not shown). The packer apparatus remains firmly in place during use. To easily remove the packer apparatus 20 from the handle 17, the user removes the screw 22 from the screw hole 18 and the corresponding pre-drilled hole (not shown), and pulls the mount portion 12 off the handle 17.

Figure 11:
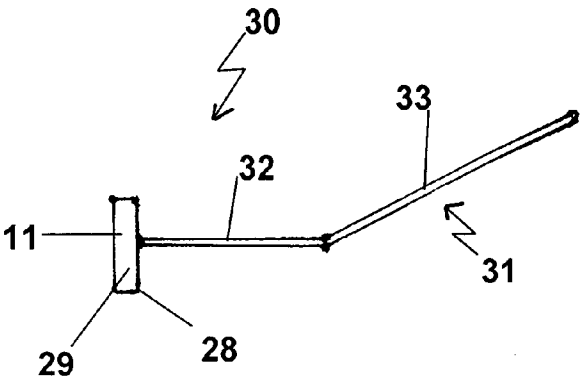
FIG. 11 is a side elevational view of the third embodiment of the packer apparatus according to FIG. 10, shown in position for use.
Figure 10:
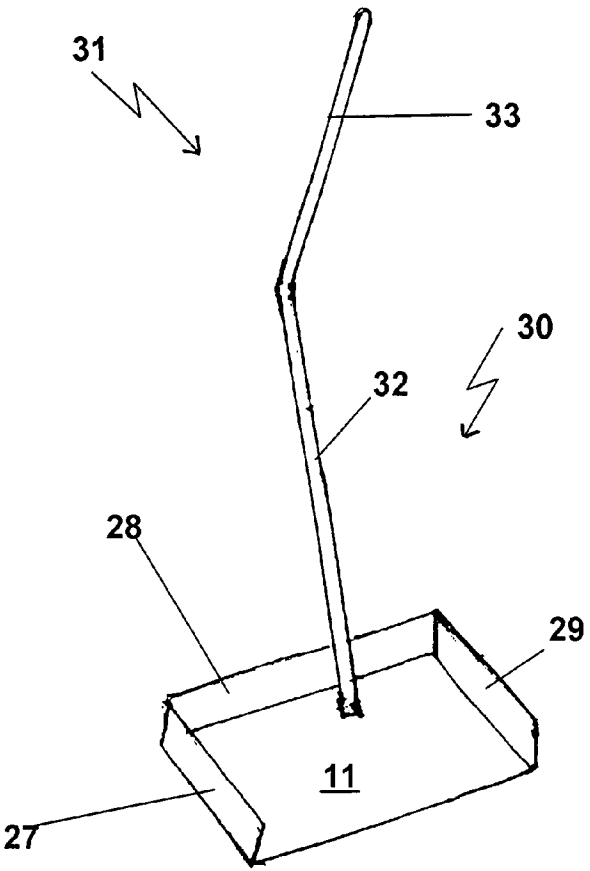
FIG. 10 is a perspective view of a third embodiment of a packer apparatus according to the present invention.

FIGS. 10 and 11 depict a third embodiment 30 of the packer apparatus of the present invention in which the head portion 11 is generally rectangular in shape and includes three, attached side walls 27, 28, 29. The first side wall 27 and the third side wall 29 are oriented substantially perpendicularly to the head portion 11 along the two, shorter, opposite, generally parallel edges of the head portion 11. The second side wall 28 is oriented substantially perpendicularly to the head portion 11 along a longer, edge of the head portion 11 so that it is also oriented substantially perpendicularly to the first side wall 27 and the third side wall 29. Instead of fitting onto a rake handle 17, the packer apparatus 30 includes its own angled handle 31. The angled handle 31 is comprised of a lower section 32 connected to an upper section 33. An end of the lower handle section 32 is adhered and oriented substantially perpendicularly to the side of the head portion 11 adjacent the side walls 27, 28, 29, and an opposite end of the lower handle section 32 joins an end of the upper handle section 33 at an angle.

As shown from the side in FIG. 11, in use, the second side wall 28 lays flat on the leaf chute 14 so that the side of the head portion 11 with no side walls faces the leaf and debris bag 15. The lower section 32 of the handle 31 protrudes straight back from the head portion 11 and the upper section 33 of the handle 31 angles upward from the lower section 32 at approximately 45 degrees. In this position, the user utilizes the packer apparatus 30 to push fallen leaves 16 or other debris from the leaf chute 14 and into the disposable leaf bag 15. The user grips the upper handle section 33 and slides the second wall 28 horizontally along the leaf chute 14 to urge fallen leaves or other debris into the leaf bag 15 or other container. The user continues to slide the second wall 28 horizontally along the leaf chute 14 until the majority of the fallen leaves 16 or other debris on the leaf chute 14 has been pressed into the leaf bag 15. At any point in this process, the user may also move the packer apparatus 30 in a generally horizontal plane so that the head portion 11 compacts fallen leaves 16 or other debris already in the leaf bag 15. Additionally, after the leaf bag is somewhat full, the user may stand the leaf bag 15 or other container upright, either while still attached to the leaf chute 14 or detached from the leaf chute 14, grip the packer handle 31, and move the packer apparatus 30 in a generally vertical direction so that the head portion 11 compacts fallen leaves 16 or other debris in the disposable leaf bag 15.

Continuing with FIGS. 10 and 11, the side walls 27–29 bordering three sides of the packer apparatus 30 allow for collection of leftover small debris particles once the piles of larger debris have been packed into the trash container. A rake or broom is used to rake or sweep the small debris into the "underside" of the head portion 11 from the side of the head portion without a side wall. The edge of the head portion side without a side wall may be angled to facilitate this task. The side walls 27–29 prevent this small, leftover debris from spilling off of the planar underside of the head portion until it can be dumped into the trash container. The packer handle 31 is used to lift the head portion 11 with the small particles on it, move it over to the trash container, and tilt the head portion so the debris can spill off the side of the head portion without a side wall into the trash container. Thus, the packer apparatus has a dual function. The rectangular shape of the packer apparatus is especially well-suited to the shape of many trash containers and paper leaf and debris bags.

Figure 12:
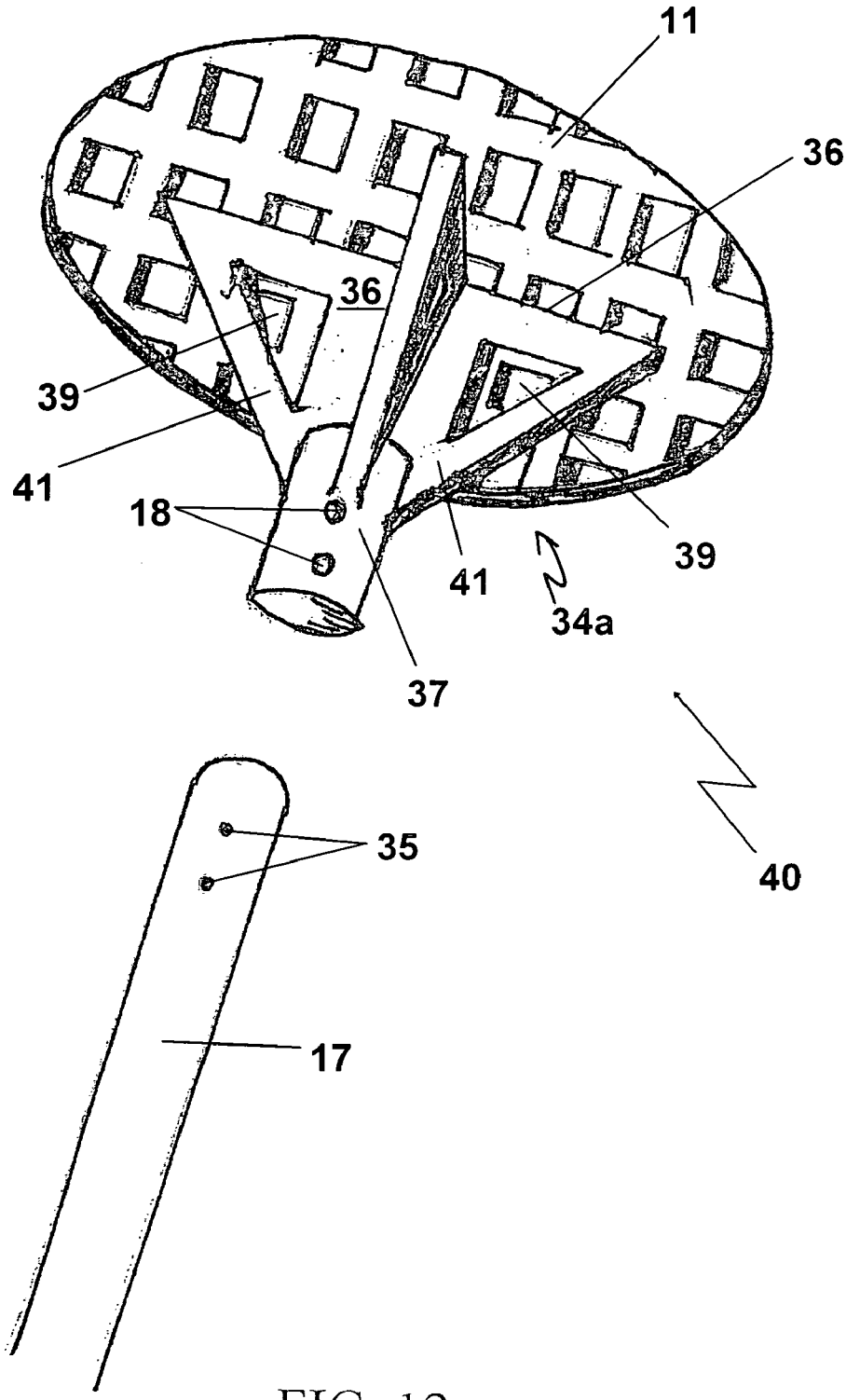
FIG. 12 is a perspective view of a fourth embodiment of a packer apparatus according to the present invention, shown with a generally circular head portion.
Figure 13:
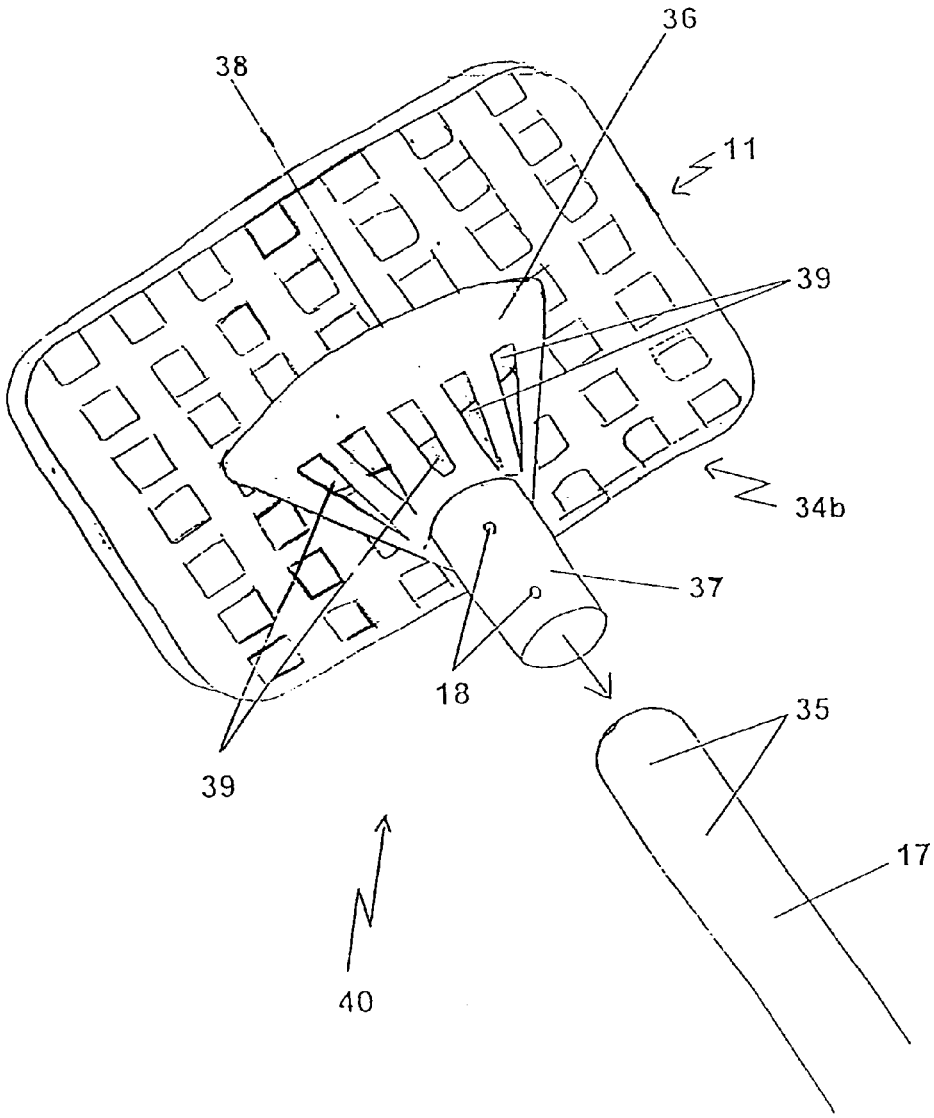
FIG. 13 is a perspective view of a fourth embodiment of a packer apparatus according to the present invention, shown with a generally rectangular head portion.
Figure 14:
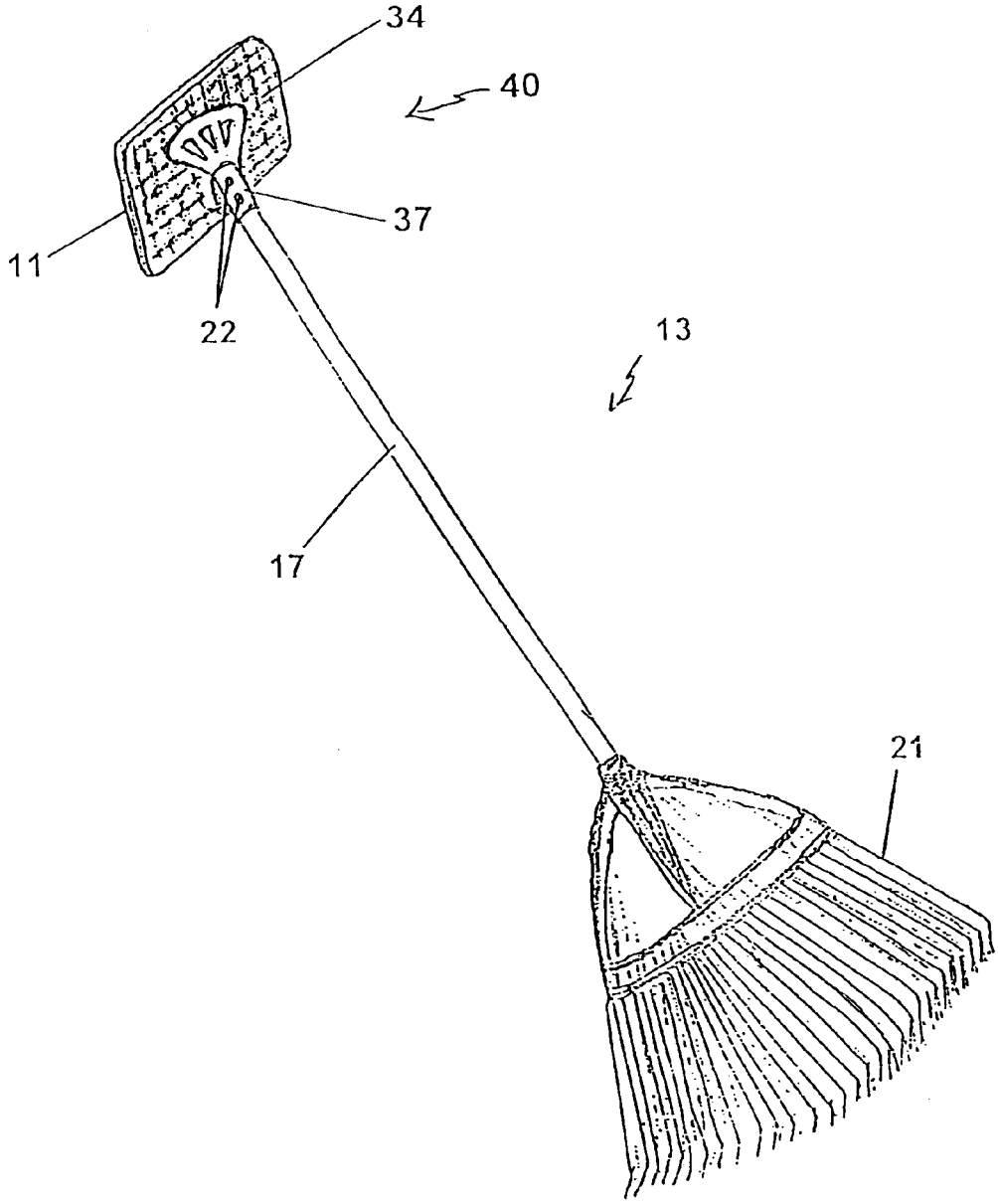
FIG. 14 is a perspective view of the packer apparatus according to FIG. 13, shown mounted on a rake handle.

Referring to FIGS. 12 through 14, a fourth embodiment 40 of the packer apparatus of the present invention is comprised of a planar head portion 11 and an open-ended, hollow mount portion 37, connected by a brace 34. The brace 34 is preferably either four-sided, as shown in FIG. 12, or hollow and generally conical in shape, as shown in FIG. 13. In the embodiment of FIG. 13, a base 36 of the generally conical-shaped brace 34*b* is connected to a central portion of the substantially planar underside of the head portion 11. The conical or four-sided shape and the connection to the central portion of the head portion convey stability to the packer apparatus. The longitudinal axis of the generally conical-shaped brace 34*b* juts out substantially perpendicularly from the head portion 11. The dual open-ended mount portion 37 is generally cylindrical in shape and hollow. Both ends of the mount portion 37 are open to facilitate a removable connection between the handle 17 and the open-ended mount portion 37, and permanent connection between the open-ended mount portion 37 and the brace 34*a,b*. One open end of the mount portion 37 is adhered to the frustum 38 of the generally conical-shaped brace 34*b*, and the longitudinal axis of the mount portion 27 is substantially longitudinally oriented to the longitudinal axis of the brace 34*b*. Preferably, the angle between the frustum 38 and the base 36 of the generally conical-shaped brace 34*b* is between about 45 and about 90 degrees.

In the preferred embodiment of FIG. 12, the four-sided brace 34*a* comprises four triangular-shaped brace arms 41, each extending out from a central longitudinal axis of the brace 34*a*. The base 36 of the four-sided brace 34*a* is attached to a central portion of the underside of the head portion 11 for stability. For both brace shapes, the head portion 11 is either generally circular or rectangular in shape, and preferably includes a number of apertures, as shown in FIGS. 12–14, so the packer apparatus is strong, yet lightweight and therefore easy to handle. The rectangular shape of the head portion is especially well-suited to the shape of many trash containers and paper leaf and debris bags. The circular shaped head portion is especially well-suited to the shape of many plastic leaf bags or circular containers.

In the embodiment shown in FIGS. 13 and 12, respectively, a number of spaced-apart, similarly sized, brace apertures 39 penetrate the frustum 38 of the generally conical-shaped brace 34*b*, and the brace arms 41 of the four-sided brace 34*a*. The brace apertures 39 further ensure that the brace 34*a,b* and, consequently, the packer apparatus 40 is lightweight yet sturdy. The number of brace apertures 39 is dependent upon the strength of the material used to construct the brace 34*a,b*, the size of the brace apertures 39, and their proximity to one another.

As illustrated in FIG. 14, the packer apparatus 40 is also designed to be attached to the handle 17 of a standard yard rake 13 by means of screws 22. Accordingly, FIGS. 12 and 13 depict spaced apart, similarly sized, screw holes 18 substantially transversely spanning the open-ended mount portion 37 and corresponding spaced-apart, similarly sized holes 35 substantially transversely spanning the upper end portion of the handle 17. The user attaches and detaches the packer apparatus 40 to the handle 17 as described above. Preferably the mount portion comprises at least two screw holes 18, and the handle 17 comprises at least two corresponding handle holes 35 in order to accommodate at least two attachment screws 22. Alternatively, the spring-loaded clamp 19 shown in FIGS. 3 through 5, which is permanently affixed to the mount portion 37, may function as an attachment mechanism.

Figure 15:
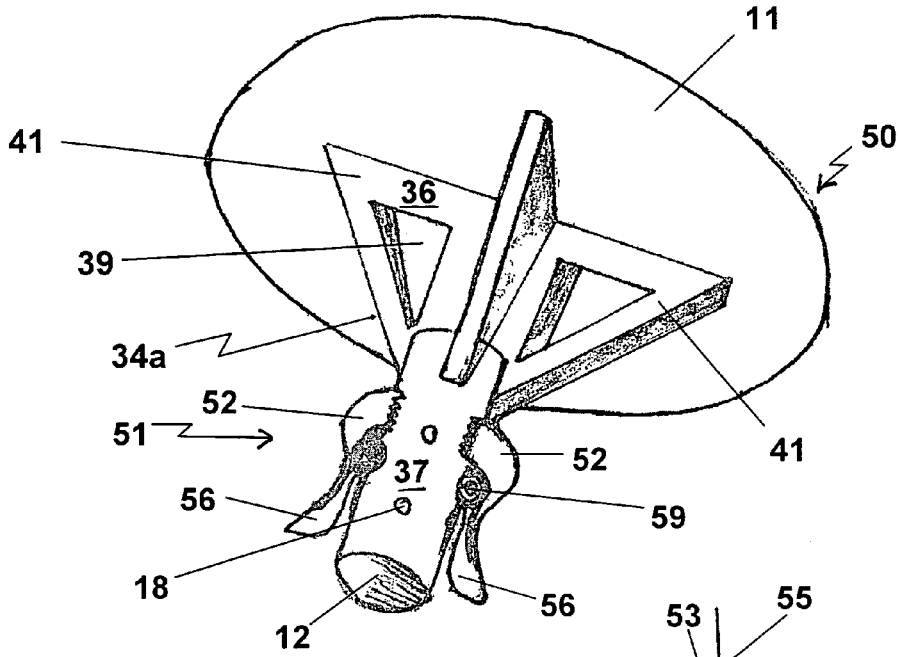
FIG. 15 is a perspective view of a fifth embodiment of a packer apparatus according to the present invention, shown with a spring-loaded mechanism for attachment to a handle.
Figure 15:
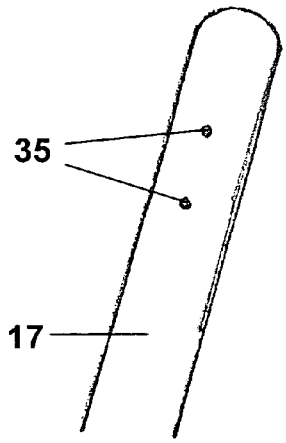
Figure 16:
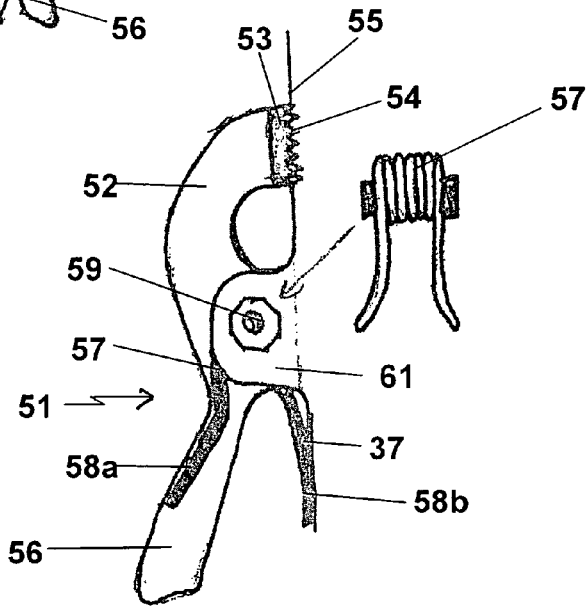
FIG. 16 is an elevational view of a portion of the fifth embodiment of the packer apparatus according to FIG. 15.

A fifth embodiment 50 of the packer apparatus of the present invention is depicted in FIGS. 15 and 16. The packer apparatus 50 relies upon a spring-loaded mechanism 51, shown in greater detail in FIG. 16, for attachment of the mount portion 52 to the broomstick-type handle 17 of the rake or other garden tool. The generally circular-shaped head portion 11 is made of a solid, durable lightweight material, such as a plastic material. Alternatively, the head portion may be grate-like (as shown in FIG. 12), or grill-like, or perforated.

As seen in FIGS. 15 and 16, the spring-loaded mechanism 51 is comprised of two arm members 52 positioned on opposite sides of the mount portion 37. An upper, inwardly curved portion of each member 52 comprises a jaw 53 with teeth 54 for gripping the handle 17. The jaws 53 are extendible through mount apertures 55 in the mount portion. A lower portion 56 of each arm member 52 extends out from the surface of the mount portion 37 for gripping. The spring-loaded mechanism 51 further comprises a spring 57, which is also shown from the side in FIG. 16. The spring 57 is movably wound around a spring pin 59, which passes through mount housing 61. The spring 57 comprises two spring ends 58*a,b*, one 58*b* of which presses against the wall of the mount portion. The other spring end 58*a*, which lies within the lower arm portion 56, exerts tension on the lower arm portion 56 away from the mount portion 37. The packer apparatus 50 includes two mirror image arm members 52 (one is shown in FIG. 16).

Thus, the packer apparatus 50 includes (a) two mirror image arm members 52 on opposite sides of the mount portion 37, each of the arm members 52 comprising an upper, inwardly curved portion comprising a toothed jaw 53, and an outwardly extending lower arm portion 56, each of the jaws 53 being extendible through an aperture 55 in the mount portion 37; and (b) a spring 57 in a central portion of each of the arm members 52, each of the springs 57 being movably wound around a spring pin 59, which passes through a mount housing 61 extending from the mount portion 37, each of the springs 57 comprising two spring ends 58*a,b*, one 58*b* of which presses against the mount portion, the other 58*a* of which presses outward on the lower arm portion 56 away from the mount portion 37; wherein the jaws 53 extend through the mount apertures 55 unless the lower arm members 56 are in a depressed position. This spring-loaded mechanism 51 may be used with the second embodiment herein, which is shown in FIGS. 6–9 and which does not include a brace, or with the conical-shaped brace embodiment shown in FIG. 13.

To insert the packer apparatus 50 on the handle, a user squeezes the lower arm portions 56 of the arm members 52 in toward the mount portion 37, which moves the jaws 53 at the upper end of the arm member out. The user inserts the end of the selected handle 17 into the hollow end 62 of the mount portion 37, then releases his or her grip on the lower arm portions. The spring 57 causes the lower arm portions 56 to return to their closed position, which moves the jaws 53 through the mount apertures 55 and against the end of the handle 17. The teeth 54 grip the handle 17, which is usually wooden. The packer apparatus 50 remains in place on the handle 17 until the user again squeezes the lower arm portions 56, which releases the grip of the jaws on the handle, and pulls the packer apparatus off the handle for storage. The mount portion 37 may also include holes 18, as shown in FIG. 15, in case the user desires instead to screw or bolt the packer apparatus onto the desired handle 17.

Figure 17:
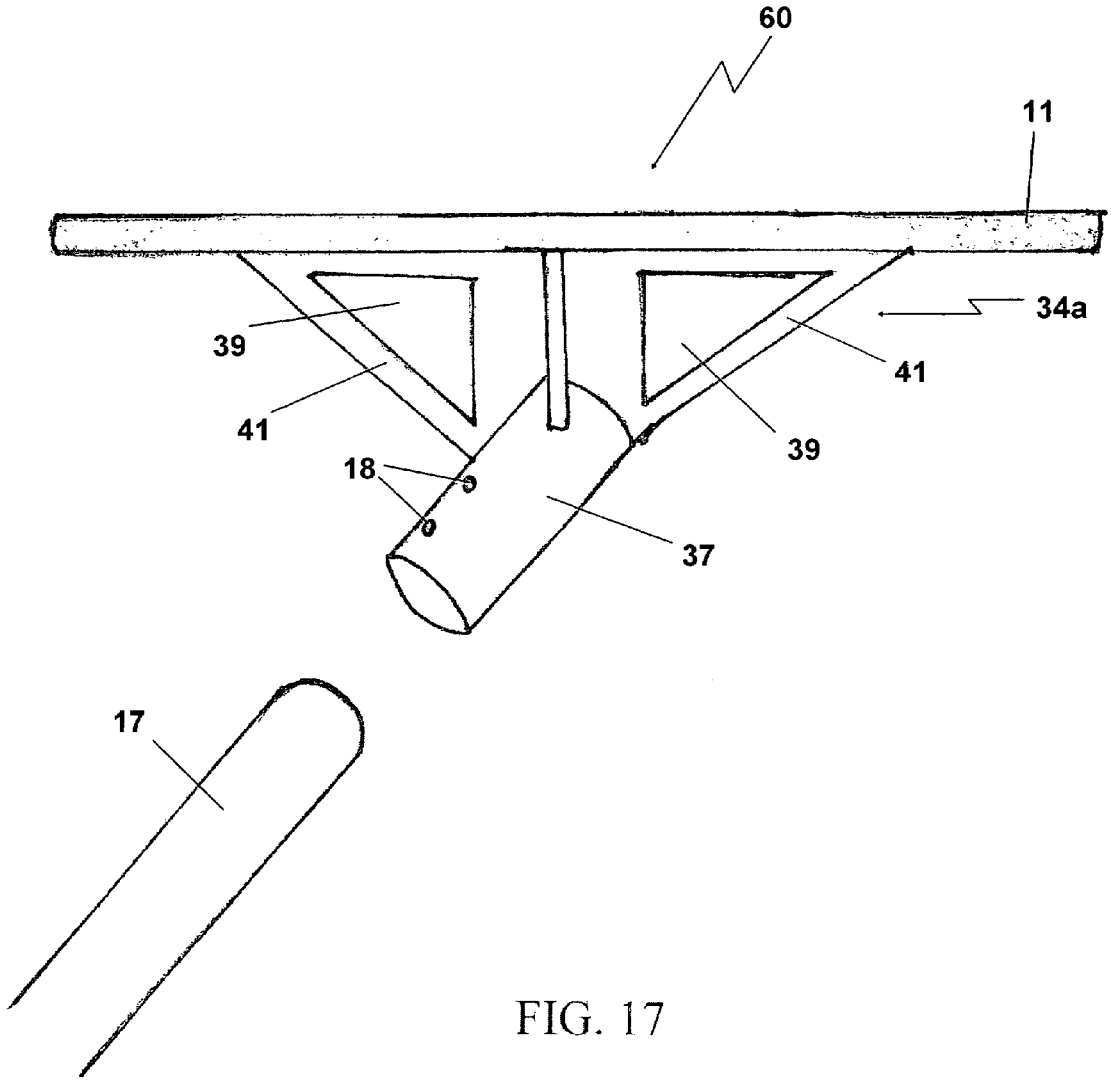
FIG. 17 is a perspective view of a sixth embodiment of a packer apparatus according to the present invention, shown with an angled head portion.

A sixth embodiment 60 of the packer apparatus of the present invention is depicted in FIG. 17. The packer apparatus 60 comprises a head portion 11 that is angled with respect to the axis of the handle 17, to facilitate movement of the leaves into the leaf container, which is laying on its side on the ground. The angle of the substantially planar head portion 11 in relation to the mount portion 37 is preferably about 45 degrees, so the user holding the other end of the handle 17 need not stoop over to as great an extent in order to push the debris into the trash container. The other end of the handle may or may not be attached to rake tines, a broom, or another gardening tool. The mount portion 37 may include holes 18 on either side for screwing or bolting the packer apparatus 60 onto the desired handle 17, or it may include the spring-loaded mechanism 51, as described above.

Preferably, the various packer device embodiments are constructed from a lightweight, durable plastic or composite material to ensure robustness yet ease of use. The inside diameter of the hollow end of the mount portion corresponds to an outside diameter of a conventional handle. The handles of many rakes and brooms have approximately the same diameter.

Excepting the third embodiment of the packer apparatus 30, to push leaves 16 or other debris into the leaf bag 15, the user stands holding the rake handle 17 at an angle, with the side of the head portion 11 opposite the handle 17 and generally facing the bag 15. Then the user simply uses the packer apparatus 10, 20, 40, or 50 to shove leaves or other debris into the leaf bag 15 or other garbage container. This process decreases the stress and work associated with bagging leaves and debris, and also saves time and energy. Optionally, the user may bend or crouch and follow the same procedure, if he or she is physically able to do so From the foregoing it can be realized that the described device of the present invention may be easily and conveniently utilized as a packer apparatus for pushing and compacting fallen leaves and other debris in a conventional plastic or paper leaf and debris bag or other trash container. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. For example, the packer apparatuses 10, 20, 40, 50 are removably installable on a handle 17 of a standard yard rake 13. Advantageously, the user can quickly alternate between raking fallen leaves 16 or other debris into piles, and pushing and packing the fallen leaves 16 or other debris into the attached leaf bag 15 or other trash container. Of course, the packer apparatuses 10, 20, 40, 50 are interchangeably installable on any suitable lone handle, or on handles connected to variety of tools, for example, a broom, hoe, shovel, etc., at the user's discretion.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. It is intended that the doctrine of equivalents be relied upon to determine the fair scope of these claims in connection with any other person's product which fall outside the literal wording of these claims, but which in reality do not materially depart from this invention.

What is claimed is:

1. A packer apparatus for pushing or packing leaves or other debris into a trash container, the packer apparatus comprising:

(a) a substantially planar head portion;

(b) a brace connected on one side to a substantially planar underside of the head portion; and (c) a mount portion connected to an opposite side of the brace, the mount portion being generally cylindrical in shape and comprising an open end for receiving an end of a handle; wherein the brace portion is generally conical in shape, and comprises a base attached to the head portion, and a frustum attached to the open end of the open-ended mount portion, and wherein a longitudinal axis of the brace is aligned with a longitudinal axis of the open-ended mount portion; and wherein the brace further comprises a plurality of spaced apart, similarly sized brace apertures extending through the frustum.

2. The packer apparatus according to claim 1, wherein the head portion is generally circular in shape.

3. The packer apparatus according to claim 1, wherein the head portion is generally rectangular in shape.

4. The packer apparatus according to claim 1, wherein the substantially planar head portion is angled with respect to a longitudinal axis of the handle.

5. The packer apparatus according to claim 1, wherein a longitudinal axis of the mount portion is angled in relation to a longitudinal axis of the head portion.

* * * * *